US005674545A

United States Patent [19]

Shakspeare et al.

[11] Patent Number: 5,674,545

[45] Date of Patent: Oct. 7, 1997

[54] COMPRESSIBLE PACKAGES FOR INFUSIBLE SUBSTANCES

[75] Inventors: Anthony Evan Shakspeare, Warnham; John Frank Thomas Stevenson, Rutland, both of Great Britain

[73] Assignee: Tidy Tea Limited, Guernsey, Channel Islands

[21] Appl. No.: 307,802

[22] PCT Filed: Mar. 26, 1993

[86] PCT No.: PCT/GB93/00620

§ 371 Date: Jan. 20, 1995

§ 102(e) Date: Jan. 20, 1995

[87] PCT Pub. No.: WO94/21361

PCT Pub. Date: Sep. 29, 1994

[30] Foreign Application Priority Data

Mar. 27, 1992 [GB] United Kingdom ..... 9206754
May 19, 1992 [GB] United Kingdom ..... 9210613

[51] Int. Cl.[6] ..... B65B 29/04; B65D 33/06

[52] U.S. Cl. ..... 426/80; 426/394

[58] Field of Search ..... 426/79, 80, 83

[56] References Cited

U.S. PATENT DOCUMENTS

| | | | |
|---|---|---|---|
| 2,308,241 | 1/1943 | Hogaboom | 426/80 |
| 2,468,464 | 4/1949 | Salfisberg | 426/77 |
| 2,791,505 | 5/1957 | Barnett | 426/79 |
| 2,881,910 | 4/1959 | Murphy | 426/80 |
| 2,986,269 | 5/1961 | Goldberg | 426/80 |
| 3,223,229 | 12/1965 | Welin-Berger | 426/79 |
| 3,237,550 | 3/1966 | Christopher | 426/80 |
| 3,396,032 | 8/1968 | McCraw et al. | 426/83 |
| 4,055,668 | 10/1977 | Kopp | 426/79 |
| 5,358,724 | 10/1994 | Raffaele | 426/80 |

FOREIGN PATENT DOCUMENTS

| | | | |
|---|---|---|---|
| 570798 | 12/1975 | Switzerland | 426/79 |
| 881784 | 11/1961 | United Kingdom | 426/79 |
| 1207024 | 9/1970 | United Kingdom | 426/80 |

*Primary Examiner*—Steven Weinstein
*Attorney, Agent, or Firm*—Bacon & Thomas

[57] ABSTRACT

An infusible package includes a closed bag, containing an infusible substance for infusion in a liquid. The bag is formed from panels of porous material sealed at their peripheral margins; and at least one string. Each string extends through a seal between the panels, enters the interior of the bag at a point on the peripheral margins and extends across the interior of the bag to an anchoring point at or adjacent the peripheral margins. The length of that portion of each string which extends across the interior of the bag between the point on the peripheral margins and the anchoring point is greater than the distance between that point and the anchoring point. With this arrangement, pulling the string initially causes withdrawal from the bag interior of slack string length disposed therein.

17 Claims, 4 Drawing Sheets

COMPRESSIBLE PACKAGES FOR INFUSIBLE SUBSTANCES

BACKGROUND OF THE INVENTION

1. Field of the Invention

This invention relates to packages for infusible substances such as tea and coffee, and to methods for their manufacture.

2. Discussion of the Prior Art

Tea bags are sealed soft porous bags containing tea leaves which are placed in cups, mugs or teapots of boiling water to produce a drink of tea. The bags can theoretically be of any shape, but are generally either rectangular or round. When the bags are placed in cups or mugs of boiling water, they are usually removed prior to the tea being drunk—this can also, although not necessarily, be the case when the bags are placed in the teapot. When removing the bags either from the cup, mug or teapot, it is quite normal to squeeze the bags into a relatively dry state, usually by employing a kitchen utensil such as a teaspoon. Removal of excess liquid from the tea bag, in order to prevent the tea bag from dripping or leaving puddles of liquid on the surface with which it is in contact, is most desirable in view of the strongly staining nature of tea. However, a problem with using such kitchen utensils is that it is not easy to achieve efficient removal of excess liquid from the tea bag, and frequently the tea bag will have a tendency to drip even after it has been squeezed. One approach to this problem has been to provide a string harness around the tea bag, the string harness being tightened about the bag after use to squeeze liquid from the bag. However, a disadvantage of such an arrangement is that the string tends to exert a very localised squeezing effect, and consequently does not efficiently express fluid from the bag. Moreover, the complexity of such string harnesses means that as a practical matter, it would be extremely difficult to produce tea bags having such harnesses efficiently and economically on a large scale.

SUMMARY OF THE INVENTION

It is an object of the present invention to overcome the aforesaid problems by providing a tea bag which has means for efficient removal of excess liquid from the bag. In particular it is an object of the present invention to provide means for removing excess liquid from the tea bag such that the tea bag thereafter does not drip.

In a first aspect, the invention provides an infusion package comprising a closed bag containing an infusible substance for infusion in a liquid, the bag being formed from panels of porous materials sealed together at their peripheral margins; and at least one string; the or each string extending through a seal between the panels, entering the interior of the bag at one point on the peripheral margins, and extending across the interior of the bag to an anchoring point at or adjacent the peripheral margins; wherein the length of that portion of the or each string which extends across the interior of the bag between the said one point and the anchoring point, is greater than the distance between the said one point and the anchoring point; the arrangement being such that pulling the or each string initially causes withdrawal from the bag interior of slack string length disposed therein.

Preferably the or each string is or are anchored by being held between two sealed-together portions of the panels.

The bag can be provided with a single string which can be tagged in known fashion. The tagged string can act as a means for suspending the bag (e.g. a tea bag) in a cup or pot.

The tag can be provided with an aperture through which the string may pass, so that the tag is slidable along the string. The sliding tag advantageously comprises two hinged panels with the aperture preferably being located on or about the hinge line. In use, the string can be used to draw the bag up into the area between the two panels which can then be squeezed to express liquid from the bag. In such an arrangement, the end of the string is conveniently provided with a fixed tag to prevent the sliding tag from sliding off the end of the string. The fixed tag can be formed integrally with the sliding tag for detachment therefrom immediately prior to use.

In another embodiment the bag can advantageously be provided with two strings which can function as drawstrings to bring about collapse of the infusion bag after use and consequent expression of excess liquid therefrom.

In a preferred embodiment of the present invention there is provided an infusion package comprising a closed bag containing an infusible substance for infusion in a liquid, the bag being formed from panels of porous materials sealed together at their peripheral margins; and a pair of drawstrings, each drawstring of which extends into the interior of the bag through a seal between the panels at a first location on the peripheral margins and extends across the interior of the bag to an anchoring point at a generally opposed location within or adjacent the peripheral margins without any intermediate inter-engagement with the said panels of the bag; each drawstring being anchored by being held between two sealed-together portions of the panels; wherein the length of that portion of the drawstring which extends across the interior of the bag between the said first location and the anchoring point, is greater than the distance between the first location and the anchoring point; the arrangement being such that pulling the drawstrings in generally opposed directions initially causes withdrawal from the tea bag interior of slack drawstring length disposed therein, and thereafter in use, further pulling of the said drawstrings in generally opposed directions causes the bag to collapse thereby to express liquid absorbed by the infusible substance during infusion.

It is preferred that the length of the portion of the string/drawstring extending across the interior of the bag between the said first location and anchoring point is greater than one and a half times the distance between the said first location and the anchoring point, and more preferably is greater than one and three quarters times the said distance.

Preferably at least 60% of the total length of each string/drawstring is disposed within the bag interior, prior to use of the infusion package. More preferably at least 65%, for example, at least 70%, of the total length of each string/drawstring is disposed within the bag interior prior to use of the bag.

Preferably the length of that portion of the string drawstring disposed externally of the infusion package and extending from said first location on the peripheral margin, prior to use of the infusion package, is no greater than 30% of the total length of each string/drawstring; more preferably is less than 25% and most preferably is less than 20% of the total length of the drawstrings.

Where two drawstrings are employed, these are preferably the two ends of a single continuous length of string, although separate lengths of string may be employed. The external ends of the drawstrings may be joined or may together form an integral loop of string extending from one point of entry into the bag to the other point of entry. However, it is preferred that the two drawstrings terminate separately externally of the bag. Preferably, each drawstring is tagged. In one embodiment a single tag is employed to link both drawstring ends. Where a single tag is used to link both drawstring ends, preferably it is provided with a point of weakness, for example a row of perforations, to enable the single tag to be torn or divided into two separate tags during use, if desired.

It is most preferred that the lengths of string/drawstring between the tags and the bag are sufficiently short, prior to use, that the tag or tags lie closely adjacent to the peripheral margins of the infusion package. This can be accomplished, for example, by ensuring that the length of string/drawstring extending between each tag and its respective first location on the peripheral margins corresponds to less than 5% of the total length of the drawstring. In one embodiment, the infusion package is of substantially rectangular form, and the tag lies along one side of the rectangle.

By minimising the lengths of the string/drawstring ends protruding from the infusion package prior to use, the result is an infusion package which is more compact and is less likely to become entangled with other infusion packages.

Where there are two drawstrings, it is preferred that the infusion package is constructed such that the drawstrings extend into the interior of the bag through the sealed margins at spaced apart (e.g. opposed) locations on the margins. It is also preferred that the pair of drawstrings are anchored at points spaced apart along the said opposed location on the peripheral margins of the bag. Preferably the arrangement of the drawstrings is symmetrical about a plane of symmetry passing through the centre of the bag.

The bags may in theory be any shape or size, but typically they are rectangular in plan. Although the bags may contain any infusible substance, it is envisaged that the invention will find its greatest application in relation to infusible substances for use in the preparation of beverages, and in particular to the bags or coffee bags.

In general, each string/drawstring extending from the bag will be tagged to permit it to be gripped more firmly. A tag may be enlarged to form an envelope for the bag if so desired. Furthermore, a tag may be enlarged to form a platform upon which the used bag may be conveyed to a waste disposal container after use. Such a form of construction is envisaged as having application to tea and coffee bags in general and not merely to the collapsible bags of the present invention.

In a further aspect, the invention provides a method of preparing the infusion packages defined hereinabove, the method comprising providing two panels of porous material and positioning the panels in mutually confronting relationship, providing a string or strings and arranging the string or strings such that they are interposed between the two confronting panels; and sealing the panels together so as to form the porous bag; the infusible substance being disposed between the panels prior to the final closure of the bag.

Where two drawstrings are provided, they may advantageously be arranged such that two drawstring strands traversing the interior of the bag lie closer to the peripheral margins than to the plane of symmetry passing through the centre of the bag. The advantage of such an arrangement is that the drawstring strands act as a pair of "dams" or barriers between which the infusion substance can be deposited, and thereafter prevent or inhibit the spreading outwards of the infusible substance into the region of the peripheral margins, thereby minimising the likelihood of particles of infusible substance being sealed into the margins.

It will be appreciated from the foregoing that in one embodiment the present invention provides an infusion package such as a tea bag which is provided with one or more string type attachments. Prior to use of the package each string type attachment is disposed mainly within the interior of the bag, and therefore prior to steeping the package in a suitable liquid, the end of the string (or a tag attached thereto) is pulled to draw the string through the seal out of the bag interior, thereby to provide sufficient length to enable the string or strings to hang freely over the lip of a cup, mug or pot containing the bag. Following a suitable period of infusion, the string attachment can then be used to lift the bag from the mug, cup or pot. Where there are two strings, these may be simultaneously pulled in generally opposite lateral directions to cause the bag to collapse thus squeezing the bag into a relatively dry state. The use of the said two attachments in this way will avoid the need to use another external utensil either to lift out or squeeze the bag e.g. the tea bag into a relatively dry state. Alternatively, where a sliding tag having two hinged panels is provided, the string can be drawn up into the region between the two hinged panels of the tag and squeezed therebetween to express liquid from the bag.

BRIEF DESCRIPTION OF THE DRAWINGS

The invention will now be illustrated in more detail by reference to the accompanying drawings in which.

DETAILED DESCRIPTION OF THE PREFERRED EMBODIMENTS

Figure 1:
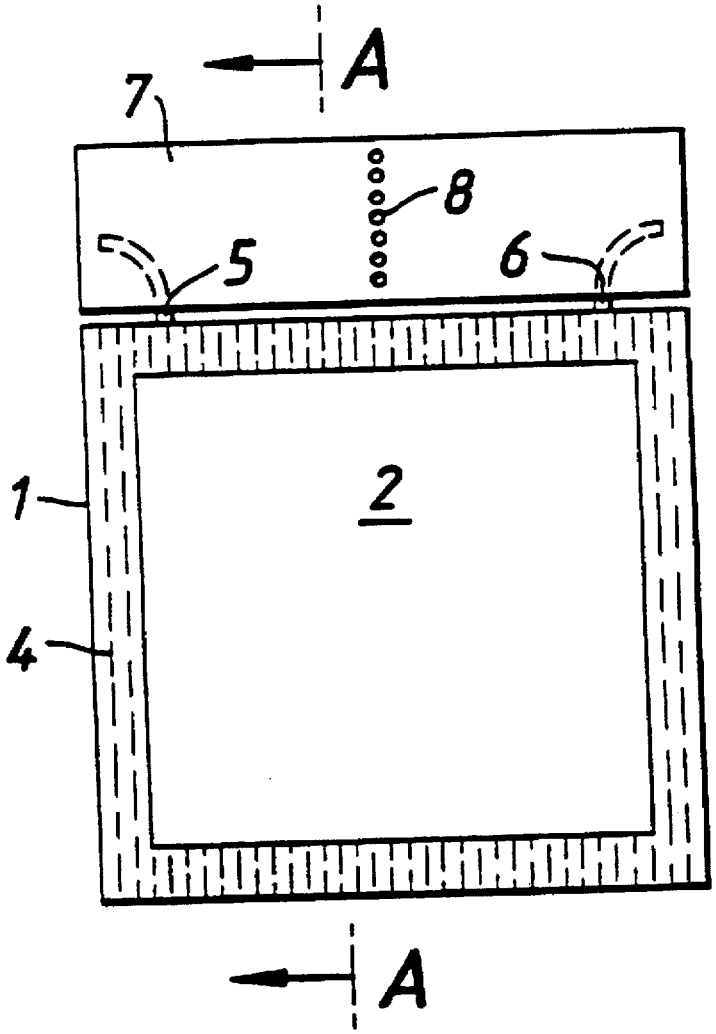
FIG. 1 is a plan view of a tea bag according to one embodiment of the invention.
Figure 2:
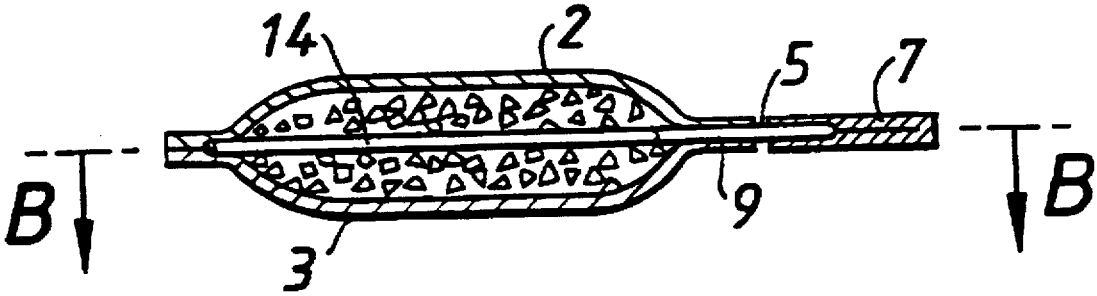
FIG. 2 is a side sectional view along line AA in FIG. 1.

Referring now to the Figures it can be seen from FIGS. 1 and 2 that the tea bag is of a generally rectangular shape comprising a bag 1 formed of a generally porous material of the type conventionally used for the tea bags. The tea bag is formed from two panels 2 and 3 of porous material heat sealed together at sealed margins 4 around its periphery. Extending from adjacent corners of the tea bag are drawstrings 5 and 6, the ends of which are attached to rectangular tag 7 which lies along one side of the tea bag. Rectangular tag 7 is provided with a row of perforations 8 which enable the tag to be divided to form two separate tags, one for each drawstring end, if desired.

Figure 3:
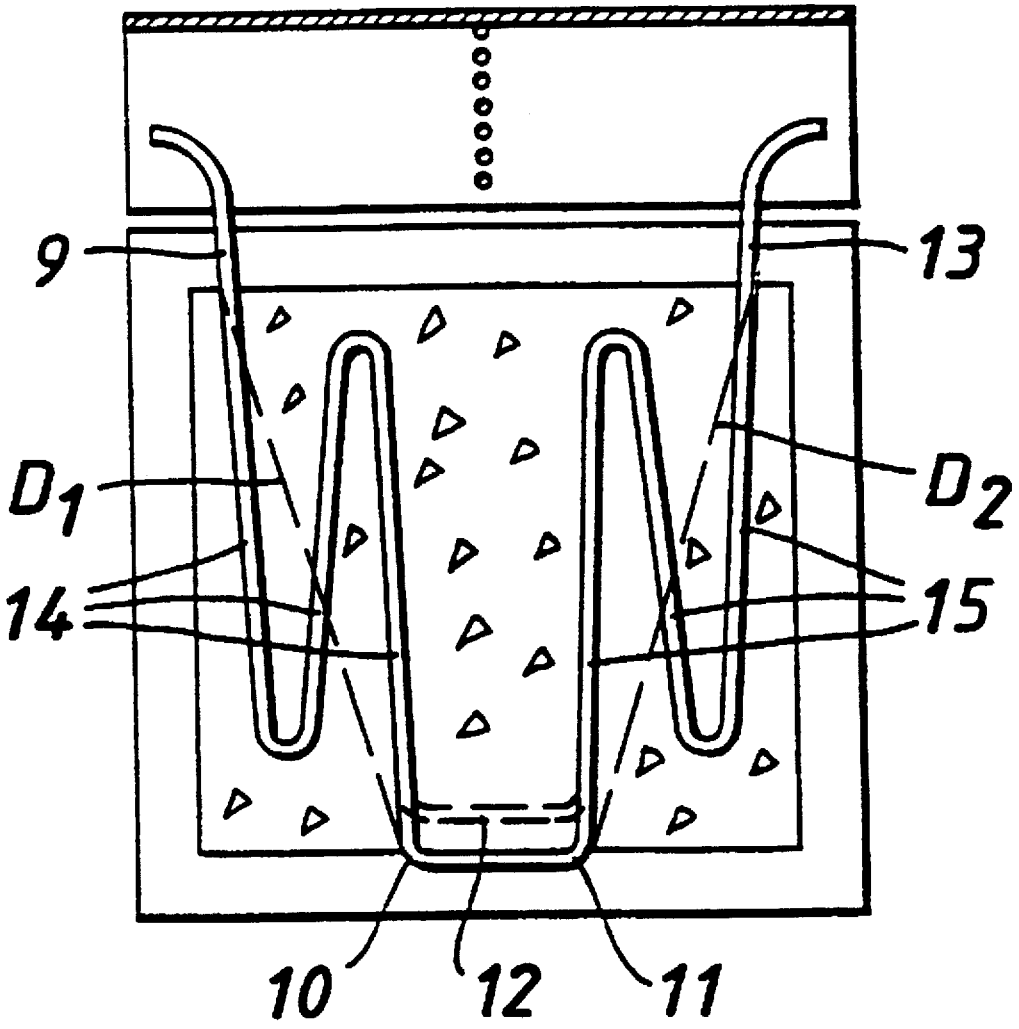
FIG. 3 is a front sectional view along lines BB in FIG. 2.

The arrangement of the drawstring within the tea bag is illustrated in greater detail in FIG. 3, where it can be seen that the drawstring ends 5 and 6 are in fact the two ends of a single continuous piece of string. The string enters the bag through the sealed margin at a point 9 and extends across the interior of the bag to point 10, the portion of string 14 between points 9 and 10 being arranged in the form of a double loop. Between point 10 and 11, the string is sealed between the panels 2 and 3, for example by means of a heat seal, and is thereby anchored. The portion 10, 11 may be anchored within the sealed margin, as shown in FIG. 3, or the anchoring point may be adjacent the peripheral margins, as shown by the dotted line 12 in FIG. 3. From anchoring point 11, the string extends in a double loop configuration 15 to point 13 whereat it exists the tea bag through the peripheral seal to the bag exterior. The end 6 of the drawstring is anchored in the tag 7. It can be seen from FIG. 3 that at no point is the string inter-engaged with either panel 2 or panel 3 of the tea bag.

FIG. 3 illustrates that the greater part of the length of the drawstring is initially retained within the interior of the tea bag, and only a length of string sufficiently long to be anchored securely in the tag 7 is disposed externally of the tea bag. Such an arrangement is more compact than existing tagged tea bags and avoids the possible entanglement between string and tags from different tea bags within a box of such bags.

Figure 4:
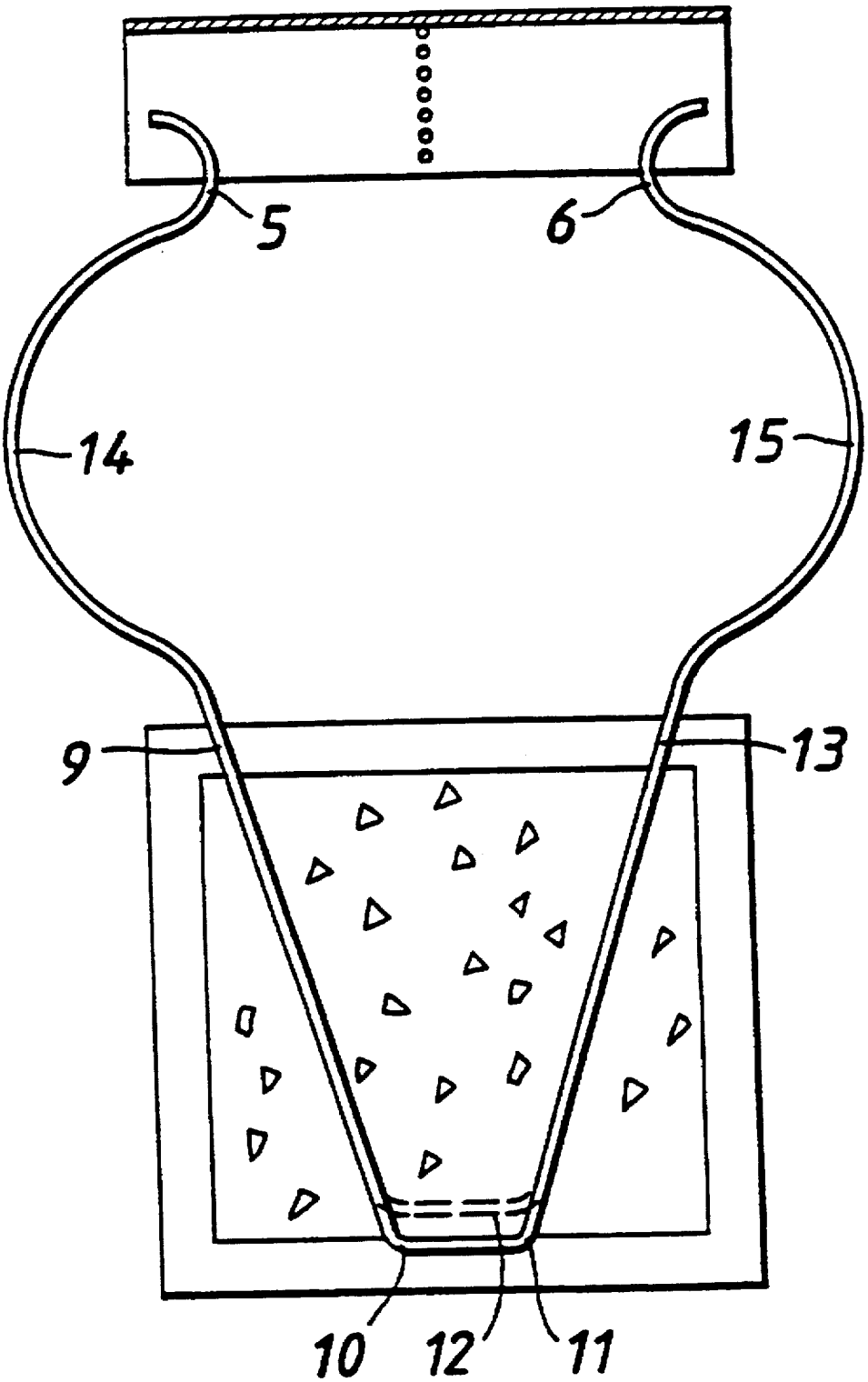
FIG. 4 is a front sectional view corresponding to FIG. 3 except that the drawstrings are shown in the extended configuration.
Figure 5:
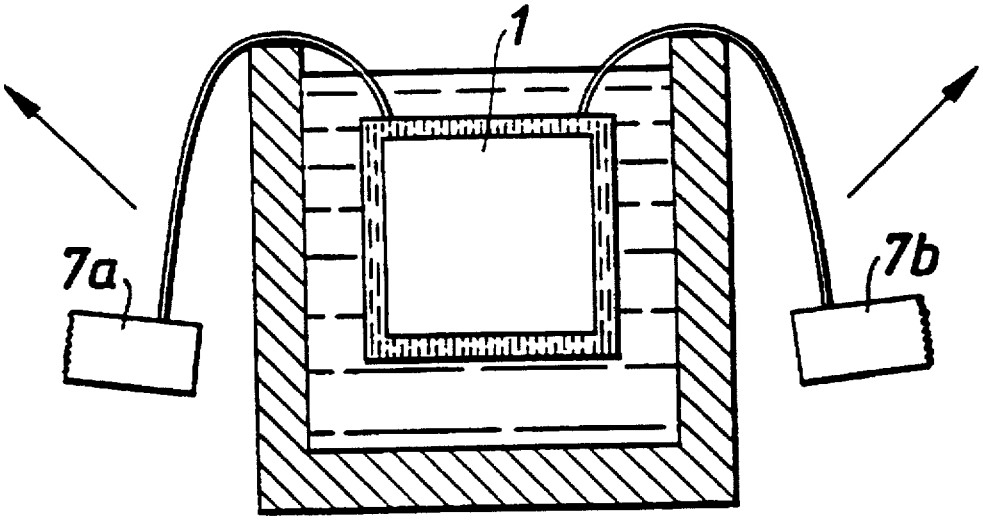
FIG. 5 is a side elevation in section of a container such as a or pot cup containing the tea bag of FIGS. 1 to 3.

In the embodiment illustrated in the Figures, approximately 85% of the total length of the drawstrings is located within the interior of the tea bag. The length of the two looped strands 14 and 15 are each approximately twice the length of the distances $D_1$ and $D_2$ between the anchoring points 10 and 11 and the respective points of entry/exit 9 and 13 on the peripheral margins. Prior to inserting the tea bag into a suitable container filled with water, or other liquid, the tag 7 is pulled away from the bag whilst holding the bag, thereby causing the drawstrings to be pulled through the peripheral margin 4 at points 9 and 13 and the slack loops of drawstring 14 and 15 to be drawn out of the bag interior. The arrangement of the drawstrings relative to the tea bag at this point is illustrated in FIG. 4. The loop defined by the tag 7 and the two drawstrings strands 5, 14 and 6, 15 may be hooked over an appropriate projection on the container (such as a teapot spout or handle or the handle of a cup) to hold the tea bag against falling into the container. Alternatively, the tag 7 may be broken along the line of perforations 8 to form two separate tags **7*a* and 7*b*. The resulting separate tags 7*a* and 7*b* may then be hung freely over the opposing lips of a cup, mug or teapot as illustrated in FIG. 5. When it is adjudged that the tea bag has been steeped in the liquid for a sufficiently long period of time, the two tags are pulled in opposed directions as illustrated by arrows in FIG. 5. This has the effect of causing the tea bag to collapse inwardly towards the centre, thus squeezing most of the liquid in the tea bag out of the bag, whilst simultaneously withdrawing the tea bag from the cup, mug or teapot. The result is a relatively dry tea bag which does not thereafter drip or leave puddles of tea on any surface with which it comes into contact. Although the string is sealed into the margins at points 9 and 13, it should be noted that when pulled in the manner described above, the string will pull through the seals. However, the string remains anchored between the panels 2 and 3 at positions 10/11** on the opposed peripheral margin.

Figure 6:
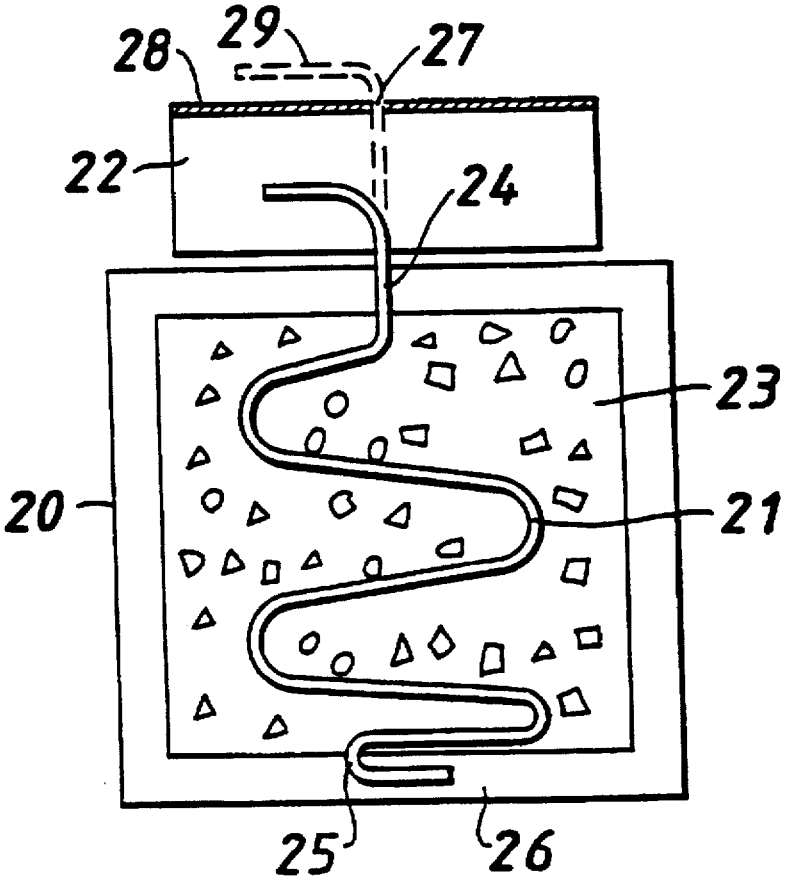
FIG. 6 is a front sectional view illustrating a tea bag having a single tagged string.

FIG. 6 illustrates a tea bag 20 having only a single string 21 which is anchored at one end within tag 22 and extends into the interior 23 of the bag through the seal between the panels of the bag at point 24. From point 24, the string extends in a triple loop to an opposed location 25 whereat it is anchored in the margin by being held between the two sealed-together panels. In use, whilst still in the dry state, the tag 22 is gripped in one hand of the user and the lower edge 26 is gripped by the other hand of the user. The tag 22 is then pulled with the result that slack length of string is pulled through the seal in a manner analagous to that illustrated in FIG. 4. The tea bag may then be suspended in a cup, tea pot or other container in known fashion. The advantage of the form of construction illustrated in FIG. 6 is that it provides a more compact product, in which the tendency for tagged strings from a number of tea bags to become entangled in the box, or during manufacture, is avoided.

In a modified version of the tea bag illustrated in FIG. 6, the tag 22 is a sliding tag which has an aperture 27 along the fold line 28, through which aperture the end of the string 29 (shown as a broken line) can pass. It will be appreciated that in this modified version, the two folded-together panels constituting the tag 22 are not sealed together and the end of the string is not anchored within the tag but is arranged to run freely through the aperture in use. With this arrangement, after use the tea bag can be pulled up between the two panels of the sliding tag which are than squeezed to express excess liquid from the tea bag.

It is contemplated that an advantageous property of the tea bags of the present invention is that they will lend themselves to efficient manufacture on a large scale. Conventional tea bag manufacture involves the use of continuous webs of porous material and, in one known process, a single web of porous material is gradually folded in half and then heat sealed along a line transverse to the fold to form a pocket into which tea is inserted. The sides of the pocket are then heat sealed in like fashion and the completed tea bag is then cut from the web or perforated to allow subsequent separation. In another method of manufacturing tea bags, two continuous webs of porous material are brought together and are heat sealed together. The method preparing the tea bags of the present invention can be substantially the same as outlined above in respect of conventional tea bags, but differs in that the drawstring or strings is laid into the space between the two individual webs or the two halves of the folded over web prior to the heat sealing steps.

The embodiments illustrated in the drawings are for the purposes of exemplification only, and it will be readily apparent to the skilled man that numerous modifications and alterations may be made to the illustrated tea bags without departing from the principles underlying the present invention. All such modifications and alterations are intended to be embraced by this application.

We claim:

1. An infusion package comprising a closed bag containing an infusible substance for infusion in a liquid, the bag being formed from panels of porous materials sealed together at their peripheral margins; said bag having an interior chamber formed between said panels and within said peripheral margins, within which said infusible substance is contained; and a pair of drawstrings, each of which extends into the interior of the bag through a seal between the panels at spaced apart entry points on the peripheral margins, and extends across the interior chamber within which said infusible substance is contained to an anchoring point at a generally opposed location from said entry points on or adjacent the peripheral margins without penetrating said panels of the bag; wherein the length of that portion of each string which extends across the interior of the bag between the said one point and the anchoring point is greater than the distance between the said one point and the anchoring point, and provides a length of slack string within the bag; and wherein each drawstring is anchored by sealed together portions of the panels at said anchoring point, the arrangement being such that pulling each string initially causes withdrawal from the bag interior of the slack string length disposed therein without collapsing the bag, and wherein further pulling of the drawstrings in generally opposed directions causes the bag to collapse thereby to express liquid absorbed by the infusible substance during infusion.

2. An infusion package according to claim 1 wherein each drawstring is anchored by being held by two sealed-together portions of the panels.

3. An infusion package according to claim 1 wherein the length of that portion of each string which extends across the interior chamber is greater than one and a half times the distance between the said entry point and the anchoring point.

4. An infusion package according to claim 3 wherein the said length extending across the interior chamber is greater than one and three quarters times the said distance between said entry point and the anchoring point.

5. An infusion package according to claim 1 wherein at least 60% of the total length of each string is disposed within the interior chamber, prior to sue of the infusion package.

6. An infusion package according to claim 1 wherein the length of that portion of each string disposed externally of the infusion package extending from said entry points on the peripheral margin prior to use of the infusion package, is no greater than 30% of the total length of the string.

7. An infusion package according to claim 1 wherein the pair of drawstrings are constituted by two ends of a single continuous length of string.

8. An infusion package according to claim 7 wherein a single tag is employed to link the two ends of said single continuous length of string.

9. An infusion package according to claim 8 wherein the said single tag is provided with a point of weakness to enable the single tag to be divided into two separate tags during use.

10. An infusion package according to claim 1 wherein each string has on an external end thereof a tag.

11. An infusion package according to claim 10 wherein the length of string between the tag and the bag is sufficiently short, prior to use, that the tag lies closely adjacent to the peripheral margins of the infusion package.

12. An infusion package according to claim 1 wherein the pair of drawstrings are anchored at points spaced apart along an opposed location on the peripheral margins of the bag.

13. An infusion package according to claim 1 where the arrangement of the drawstrings is symmetrical about a plane of symmetry passing through the center of the bag.

14. An infusion package according to claim 1 wherein the pair of drawstrings are constituted by two ends of a single continuous length of string, and a loop of the said continuous length of string is held at said anchoring point.

15. An infusion package according to claim 14 wherein the said loop is anchored within the peripheral margin.

16. An infusion package according to claim 14 wherein the said loop is anchored inwardly of the peripheral margin.

17. A method of preparing an infusion package comprising: forming a bag from panels of porous material having peripheral margins and sealing said panels together at said peripheral margins, said bag having an interior chamber formed between said panels and within said peripheral margins, placing an infusible substance in said interior chamber, and wherein prior to said sealing said panels, positioning a pair of drawstrings relative to said bag such that each extends into the interior of the bag through a seal between the panels at spaced apart entry point on the peripheral margins, and extends across the interior chamber within which said infusible substance is contained to an anchoring point at a generally opposed location from said entry points on or adjacent the peripheral margins without penetrating said panels of the bag, said sealing said panels anchoring each drawstring such that each is anchored by sealed together portions of the panels at said anchoring point, and the length of that portion of each string which extends across the interior of the bag between said entry point and the anchoring point is greater than the distance between said entry point and the anchoring point, and provides a length of slack string within the bag, the arrangement being such that pulling each string initially causes withdrawal from the interior chamber of the slack string length disposed therein without collapsing the bag, and further pulling of the drawstrings in generally opposed directions causes the bag to collapse thereby to express liquid absorbed by the infusible substance during infusion.

* * * * *